US008857392B2

(12) United States Patent
Von Gaisberg-Heifenberg et al.

(10) Patent No.: US 8,857,392 B2
(45) Date of Patent: Oct. 14, 2014

(54) CAMSHAFT ADJUSTING DEVICE FOR A MOTOR VEHICLE ENGINE

(71) Applicant: Daimler AG, Stuttgart (DE)

(72) Inventors: Alexander Von Gaisberg-Heifenberg, Beilstein (DE); Thomas Stolk, Kirchheim (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/716,162

(22) Filed: Dec. 16, 2012

(65) Prior Publication Data

US 2013/0104823 A1 May 2, 2013

Related U.S. Application Data

(63) Continuation-in-part of application No. PCT/EP2011/002883, filed on Jun. 11, 2011.

(30) Foreign Application Priority Data

Jul. 9, 2010 (DE) ..... 10 2010 026 658

(51) Int. Cl.

| | |
|---|---|
| ***F01L 1/34*** | (2006.01) |
| ***F01L 1/344*** | (2006.01) |
| ***F01L 1/356*** | (2006.01) |
| *F01L 1/352* | (2006.01) |

(52) U.S. Cl.

CPC ..... *F01L 1/344* (2013.01); *F01L 2001/3522* (2013.01); *F01L 1/352* (2013.01); *F01L 1/356* (2013.01)

USPC ..... 123/90.17; 123/90.15

(58) Field of Classification Search

CPC ..... F01L 1/3442

USPC ..... 123/90.11, 90.15, 90.17, 90.31

See application file for complete search history.

(56) References Cited

U.S. PATENT DOCUMENTS

| | | | | |
|---|---|---|---|---|
| 5,361,736 | A | 11/1994 | Phoenix et al. | |
| 2003/0230265 | A1 * | 12/2003 | Taylor et al. ..... | 123/90.15 |
| 2009/0241877 | A1 | 10/2009 | Hoshikawa et al. | |

FOREIGN PATENT DOCUMENTS

| | | |
|---|---|---|
| DE | 38 42 267 | 6/1990 |
| DE | 41 11 153 | 1/1992 |
| DE | 198 04 575 | 9/1998 |
| EP | 0 063 038 | 10/1982 |
| EP | 1 607 591 | 12/2005 |
| JP | 10 220 209 | 8/1998 |
| JP | 2009 236 090 | 10/2009 |
| JP | 2010 065652 | 3/2010 |

* cited by examiner

*Primary Examiner* — Zelalem Eshete

(74) *Attorney, Agent, or Firm* — Klaus J. Bach

(57) ABSTRACT

In a motor vehicle camshaft adjusting device which comprises an open- and/or closed-loop control unit for adjusting the camshaft phase position in a normal operating mode to a temporarily intermittently constant phase position, the open- and/or closed loop control unit has an engine start operating mode in which the camshaft phase position is advanced during opening of the valve so as to provide a valve opening angle range which is smaller than a geometric normal opening angle range based on a crankshaft angle range.

10 Claims, 3 Drawing Sheets

CAMSHAFT ADJUSTING DEVICE FOR A MOTOR VEHICLE ENGINE

This is a continuing application of pending international patent application PCT/EP2011/002883 filed Jun. 11, 2011 and claiming the priority of German patent application 10 2010 026 658.2 filed Jul. 9, 2010.

BACKGROUND OF THE INVENTION

The invention relates to a motor vehicle camshaft adjusting device with a control unit for changing the phase position of a camshaft relative to a crankshaft.

From DE 41 11 153 A1, a motor vehicle camshaft adjusting device is known, which comprises an open- and/or closed-loop control unit which is provided for adjusting a phase position of at least one camshaft in a normal operating mode to an at least intermittently constant phase position.

It is in particular the object of the present invention to improve a starting behavior of a motor vehicle internal combustion engine.

SUMMARY OF THE INVENTION

In a motor vehicle camshaft adjusting device which comprises an open- and/or closed-loop control unit for adjusting the camshaft phase position in a normal operating mode to a temporarily intermittently constant phase position, the open- and/or closed loop control unit has an engine start operating mode in which the camshaft phase position is advanced during opening of the valve so as to provide a valve opening angle range which is smaller than a geometric normal opening angle range based on a crankshaft angle range.

This makes it possible to set an advantageous valve opening angle range for starting an internal combustion engine of a motor vehicle in a way which is to a large extent independent of the actual geometric shape of the cam. In this way, a starting behavior of an internal combustion engine of a motor vehicle can be improved. The term "open- and/or closed-loop control unit" should in particular be understood to describe a unit with at least one control unit. The term "control unit" should in particular be understood to describe a unit comprising a processor unit and a memory unit as well as an operating program stored in the memory unit. The open- and/or closed-loop control unit can in principle consist of several control units connected to one another, which are preferably provided for communicating with one another via a bus system, such as a CAN bus system in particular. The term "provided" should in particular be understood to mean specially programmed, equipped and/or designed. The term "engine start operating mode" should in the present context in particular be understood to describe a mode of the open- and/or closed-loop control unit in which an open- and/or closed-loop start control program for the motor vehicle camshaft adjusting device is executed. The term "constant phase position" should in particular be understood to describe a phase position which is constant over at least one camshaft revolution. The term "at least intermittently" should in particular be understood to describe a period of time in which the operating conditions of the internal combustion engine remain unchanged. The term "valve opening angle range" should in particular be understood to describe a crankshaft angle range within which a crankshaft rotates about its main axis of rotation while an inlet valve of the motor vehicle internal combustion engine is displaced by the camshaft. The term "normal opening angle range" should in particular be understood to describe a crankshaft angle range within which a crankshaft rotates while the inlet valve is displaced by the continuously rotating camshaft. The term "geometric normal opening angle range" should in particular be understood to describe the normal opening angle range predetermined by the geometric shape of the cam. In the engine start operating mode, the valve opening angle range is preferably less than 95% of the geometric normal opening angle range.

It is further proposed that the open- and/or closed-loop control unit is provided for switching from the engine start operating mode to the normal operating mode no earlier than at an engine starting time. As a result, the switchover is advantageously delayed to a point in time at which a constant phase position of the camshaft is required. The term "engine starting time" should in particular be understood to describe a point in time at which a first cylinder of the motor vehicle internal combustion engine has fired. In an advantageous development, all cylinders of a motor vehicle internal combustion engine have fired at least once at a switchover time when the open- and/or closed-loop control unit switches from the engine start operating mode to the normal operating mode. All cylinders of the motor vehicle internal combustion engine will advantageously have fired precisely once. The term "fired" should in particular be understood to mean that an ignitable fuel mixture in the cylinder is made to combust by a spark and/or a self-ignition process.

It is further proposed that the open- and/or closed-loop control unit is provided for switching from the engine start operating mode to the normal operating mode no later than on reaching an idling speed. In this way, a detectable point in time can be used for the switchover in a particularly simple way. The term "idling speed" should in particular be understood to describe a crankshaft speed from which a motor vehicle internal combustion engine can be kept running autonomously by the ignition of the fuel mixture without a rotation of the crankshaft having to be supported externally, for example by a starter. At idling speed, the drive train of a motor vehicle is not loaded, and the motor vehicle engine does not transmit any torque to drive wheels. The term "normal operating mode" should in particular be understood to describe an operating mode in which the motor vehicle internal combustion engine is operated at least at idling speed.

It is further proposed that the motor vehicle camshaft adjusting device comprises a highly dynamic camshaft adjuster which is provided for adjusting the phase position of the camshaft. In this way, a valve opening range can be changed particularly simply and fast. The term "highly dynamic camshaft adjuster" should in particular be understood to describe a fast acting and reacting camshaft adjuster. The highly dynamic camshaft adjuster has a potential adjusting speed which enables it to adjust the phase position of the camshaft by at least 95% of its adjusting range within one revolution of the camshaft.

It is further proposed that the camshaft adjuster has a camshaft adjusting range which covers a crankshaft angle range of at least 120 degrees. In this way, a camshaft adjuster having particularly advantageous adaptation facilities can be provided, whereby both a good starting behavior and good running in the normal operating mode of the motor vehicle internal combustion engine can be ensured. The term "camshaft adjusting range" should in particular be understood to describe an angle range within which the camshaft can be rotated from a normal position with respect to the crankshaft. In an advantageous development, the camshaft adjuster has a camshaft adjusting range of 100 degrees. The term "crankshaft angle range" should in particular be understood to describe an angle range within which the crankshaft rotates about its main axis of rotation in a defined time.

In addition, it is proposed that the camshaft adjuster is an electromagnetic camshaft adjuster. In this way, a structurally simple, highly dynamic camshaft adjuster can be provided.

It is further proposed that the camshaft adjuster is provided for adjusting the valve opening angle range in the engine start operating mode to a value which corresponds to the normal opening angle range minus half of the camshaft adjusting range. In this way, a valve opening angle range can be set in which cylinders of the motor vehicle internal combustion engine can be filled very advantageously in the engine start operating mode, whereby a starting behavior can be further improved in particular. In an advantageous development, the valve opening angle range corresponds to a value which corresponds to the normal opening angle range minus almost the whole of the camshaft adjusting range. The term "almost the whole of the camshaft adjusting range" should be understood to describe 80% of the camshaft adjusting range in an advantageous variant, 90% of the camshaft adjusting range in a more advantageous variant, and 98% of the camshaft adjusting range in a particularly advantageous variant.

It is further proposed that the camshaft adjuster comprises an adjusting unit which is provided for actively adjusting the valve opening angle range in the engine start operating mode. In this way, the setting of the valve opening angle range can advantageously be adjusted precisely and simply. It is in particular possible to obtain a fast adjustment of the valve opening angle range.

It is further proposed that the open- and/or closed-loop control unit is provided for cyclically selecting the adjusting unit in the engine start operating mode.

In this way, the effect of the advantageous filling of the cylinders can be supported in a particularly advantageous manner.

Further features and advantages will become apparent from the following description on the basis of the accompanying drawings. The drawings show a particular embodiment of the invention.

DESCRIPTION OF A PARTICULAR EMBODIMENT

Figure 1:
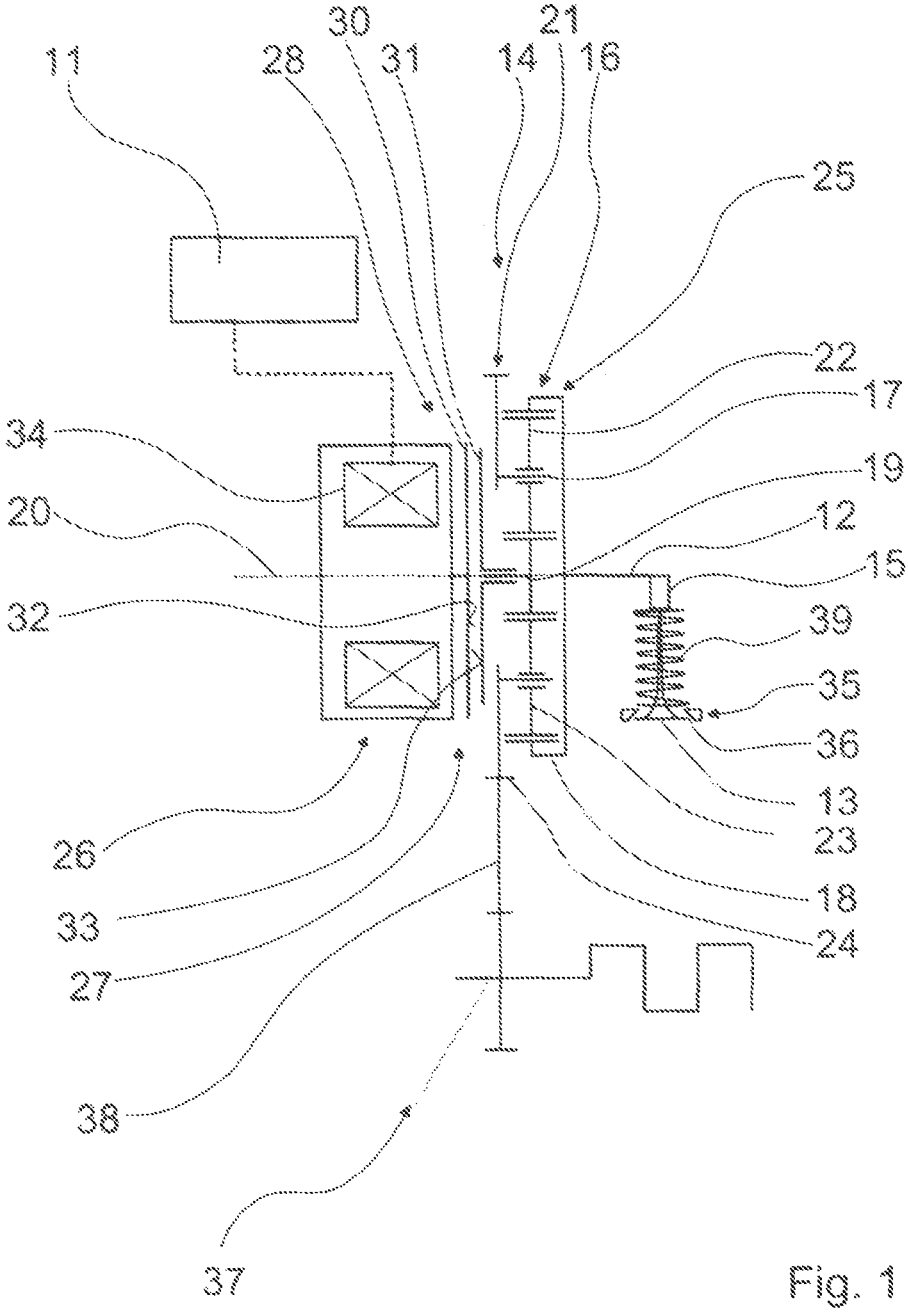
FIG. 1 is a diagrammatic representation of an internal combustion engine fitted with an engine camshaft adjusting device according to the invention.
Figure 2:
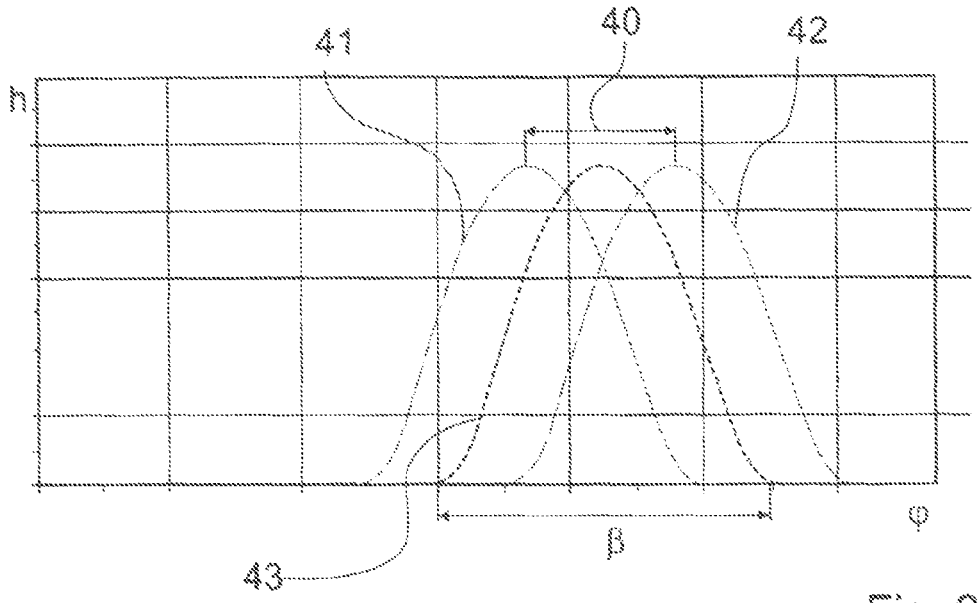
FIG. 2 is a diagram with a valve stroke characteristic 43 for a geometric normal opening angle range $\beta$, plotting a valve stroke h over a crankshaft angle $\phi$.
Figure 3:
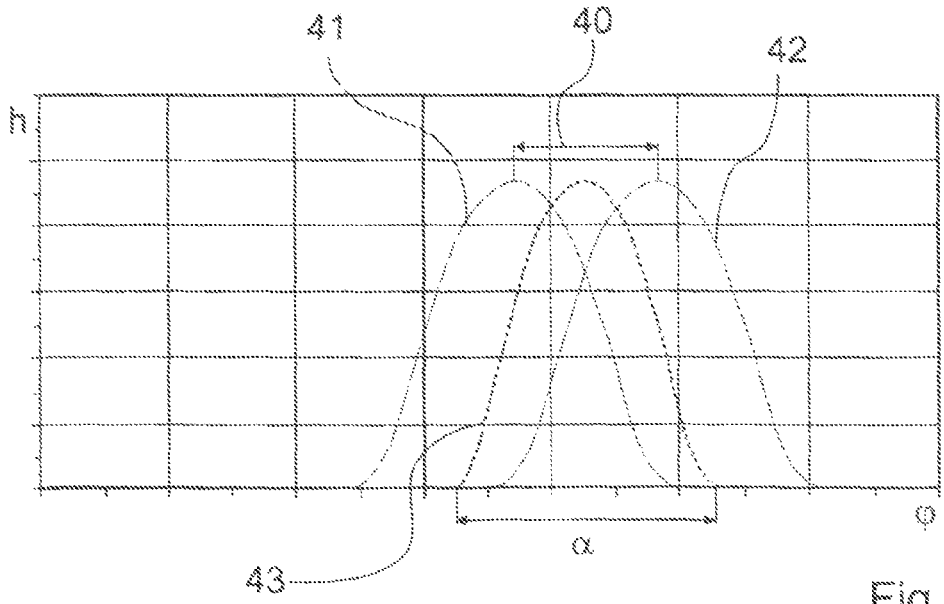
FIG. 3 is a diagram with a valve stroke characteristic 43 for a valve opening angle range $\alpha$ at minimum engine speed, plotting a valve stroke h over a crankshaft angle $\phi$.
Figure 4:
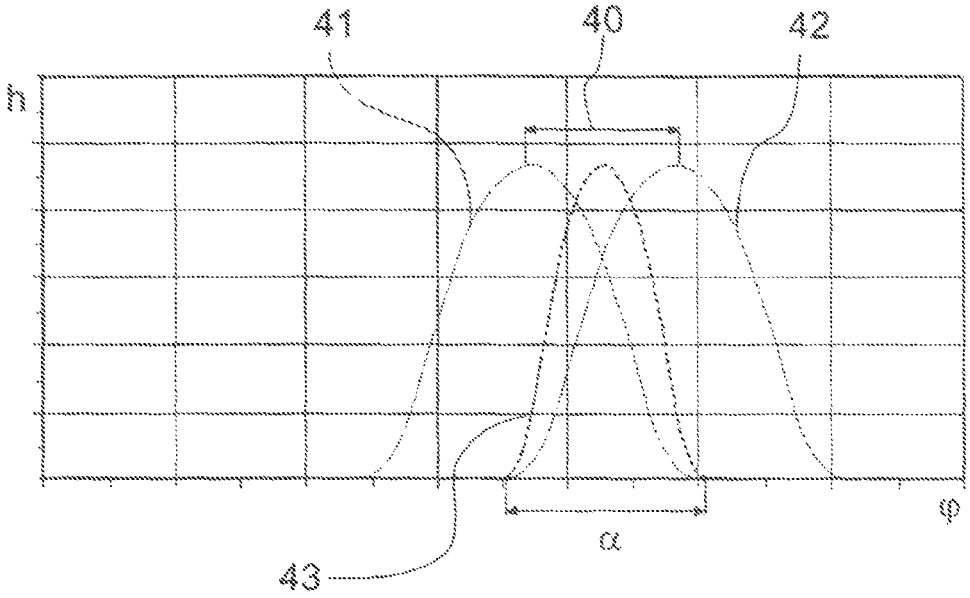
FIG. 4 is a diagram with a valve stroke characteristic 43 for a valve opening angle range $\alpha$ at an engine start and a starter speed, plotting a valve stroke h over a crankshaft angle $\phi$.

FIG. 1 is a diagrammatic representation of an internal combustion engine of a motor vehicle fitted with a camshaft adjusting device for the internal combustion engine. The camshaft adjusting device comprises a camshaft 12 and a camshaft adjuster 14 which is provided for adjusting a phase position of the camshaft 12 relative to a crankshaft 37. The camshaft 12 is driven by the crankshaft 37 of the motor vehicle internal combustion engine. To join the camshaft 12 to the crankshaft 37, the internal combustion engine device comprises a chain drive 38 which actively connects the crankshaft to the camshaft adjuster 14. The camshaft 12 is for example an intake camshaft and has at least one cam 15 actuating an inlet valve 13.

The chain drive 38 has a ratio of 0.5. The camshaft adjuster 14, which is designed as a highly dynamic camshaft adjuster, has a camshaft adjusting range 40 which covers a camshaft angle range of 50 degrees. Owing to the ratio of the chain drive 38, the camshaft adjusting range 40 of the camshaft adjuster 14 therefore covers a crankshaft angle range of 100 degrees. The camshaft adjuster 14 is in the form of an electromechanical camshaft adjuster.

For the adjustment of the phase position, the camshaft adjuster 14 comprises an adjusting gear 16. The adjusting gear 16 is a 3-shaft-minus-summing gear mechanism. It comprises three adjusting gear elements 17, 18, 19, by means of which the phase position of the camshaft 12 can be adjusted. The adjusting gear 16 is in the form of a planetary gear mechanism. The adjusting gear 16 comprises a main axis of rotation 20 on which the three adjusting gear elements 17, 18, 19 are rotatable. Other 3-shaft-minus-summing gear mechanisms are conceivable in principle.

To introduce a torque, the camshaft adjuster 14 comprises a drive unit 21 which includes the first adjusting gear element 17. The adjusting gear element 17 is a planet carrier which guides planets 22, 23 of the adjusting gear on a circular orbit. The drive unit 21 further comprises a sprocket 24 which is connected to the adjusting gear element 17 for rotation therewith. The sprocket 24 forms a part of the chain drive 38 by means of which the camshaft 12 is joined to the crankshaft 37. To transmit the torque, the camshaft adjuster 14 comprises an output unit 25 which includes the second adjusting gear element 18. The adjusting gear element 18 has an internal gear structure which meshes with the planets 22, 23 guided by the planet carrier. The output unit 25 is connected to the camshaft 12. To adjust the phase position, the camshaft adjuster 14 comprises an adjusting unit 26 which includes the third adjusting gear element 19. The adjusting gear element 19 is a sun gear which likewise meshes with the planets 22, 23 guided by the planet carrier 17.

To adjust a valve opening angle range $\alpha$ and the phase position, the camshaft adjuster 14 comprises an actuating unit 27. The actuating unit 27 is designed as a brake unit. The actuating unit 27 comprises an actuating device which is oriented parallel to the main axis of rotation 20. The actuating unit 27 comprises a stationary stator 28 and a rotatably mounted rotor 29. The rotor 29 is non-rotatably connected to the third adjusting gear element 19. It is axially movable on the third adjusting gear element. The actuating unit 27 comprises a first coupling element 30 which is non-rotatably connected to the stator 28 and a second coupling element 31 which is connected to the rotor 29. Each of the coupling elements has a friction surface 32, 22. The two coupling elements 30, 31 can be engaged with each other by frictional force.

The stator 28 comprises a solenoid coil unit 34. The solenoid coil unit 34 generates a magnetic field by means of which the actuating unit 27 is actuated. If the solenoid coil unit 34 generates a magnetic field, the coupling element 31 of the rotor 29 is pulled against the coupling element 30 of the stator 28. As a result, the friction surfaces 32, 33 generate a braking torque between the coupling elements 30, 31. This braking torque, which can be provided by the actuating unit 27, acts on the third adjusting gear element 19. By means of the actuating unit 27, a speed of the adjusting gear element 19 can be adjusted to a particular value.

If the phase position of the camshaft 12 is to be kept constant, a braking torque is generated by means of the actuating unit 27 which is high enough to ensure that the speeds of the adjusting gear element 17 of the drive unit 21 and of the adjusting gear element 19 of the adjusting unit 26 are identical. As a result, the camshaft 12 rotates at precisely half the speed of the crankshaft owing to the ratio of the chain drive 38. For advancing the camshaft 12, the braking torque is increased relative to the braking torque at the normal operation phase angle. This accelerates the adjusting gear element 19. For retard, the braking torque is reduced relative to the braking torque at constant phase angle. This decelerates the adjusting gear element 18. To limit the phase position adjustment, the camshaft adjuster has an advance stop and a retard stop. The advance stop is a mechanical stop which limits a phase position advance to a maximum advance 41. The retard stop is a mechanical stop which limits a phase position retard to a maximum retard 42.

The engine camshaft adjusting device is provided for an engine with at least one inlet valve 13. The engine comprises at least one cylinder and a cylinder head 35. The inlet valve 13 is located in an intake port of the cylinder and, in a closed state, seals a combustion chamber bounded by the cylinder head 35. The inlet valve 13 is seated in a valve seat 36 formed in the cylinder head 35. In the closed state, the inlet valve 13 seals the combustion chamber against the intake port. The cylinder head 35 further comprises a valve spring 39. The valve spring 39 is a coil spring which is supported against the cylinder head. The valve spring 39 pushes the inlet valve 13 into the valve seat 36. The valve spring 39 generates a valve closing force by which the inlet valve 13 is pushed onto the valve seat 36. The motor vehicle internal combustion engine comprises a plurality of analogous cylinders, each of them having at least one inlet valve. The inlet valves are basically identical and function in the same way. In the following description, it is therefore referred to the inlet valve 13 and its function only.

The inlet valve 13 is actuated by the camshaft 12. For this purpose, the camshaft has the cam 15 which is in functional contact with the inlet valve 13. In an actuated state, the camshaft 12 pushes the inlet valve 13 from the valve seat 36 by means of the cam 15. In this process, the valve force of the valve spring 39 acts against the force generated by the cam 15. If the inlet valve 13 is open, the combustion chamber is flow-connected to the intake port. In an inactive state of the inlet valve 13, the combustion chamber is separated from the intake port. Through the open inlet valve 13, a fuel mixture can flow from the intake port into the combustion chamber of the cylinder. Basically, it is possible for only one component of the fuel mixture, e.g. air, to flow from the intake port into the combustion chamber, while a fuel is, for example, directly injected into the combustion chamber.

The motor vehicle camshaft adjusting device further comprises an open- and closed-loop control unit 11. The open- and closed-loop control unit 11 adjusts the camshaft 12 to a defined phase position by means of the camshaft adjuster 14. An operating program which varies the magnetic field of the solenoid coil unit 34 for adjusting the phase position is stored in the open- and closed-loop control unit 11. By varying the magnetic field of the solenoid coil unit 34, the open- and closed-loop control unit 11 alters the braking torque of the actuating unit 27. The open- and closed-loop control unit 11 adjusts the phase position of the camshaft 12 to the defined normal operation phase position after an engine start time. During the operation of the motor vehicle internal combustion engine, the open- and closed-loop control unit 11 adjusts the phase position of the camshaft 12 to varying operating situations.

For a normal operating mode, the open- and closed-loop control unit 11 initially adjusts the camshaft 12 to a phase position representing an idling phase position, which is designed for the operation of the motor vehicle internal combustion engine at idling speed. In the normal operating mode, the phase position of the camshaft 12 is constant. The valve opening angle range $\alpha$ within which the inlet valve 13 is opened corresponds to a geometric normal opening angle range in the normal operating mode. The geometric normal opening angle range is defined by a geometry of the cam 15. The cam 15 covers a defined angle range on the camshaft 12. The range $\alpha$ within which the inlet valve 13 is opened at constant phase position is therefore defined based on the ratio between the crankshaft 37 and the camshaft 12.

At an engine start, the open- and closed-loop control unit 11 first executes an initialization mode. In the initialization mode, the crankshaft 37 is rotated about its main axis of rotation precisely once to calibrate a sensor system of the motor vehicle internal combustion engine.

For the following engine start, the open- and closed-loop control unit 11 has an engine start operating mode. The engine start operating mode controls, in an open or closed loop, the camshaft adjuster 14 of the motor vehicle camshaft adjusting device before the engine start time. The engine start operating mode immediately follows the initialization mode. In principle, the engine start operating mode may overlap with the initialization mode in time.

The engine start operating mode sets a valve opening angle range $\alpha$ which is smaller than a geometric normal opening angle range $\beta$. The setting of the valve opening angle range $\alpha$ is determined by speed, the valve opening angle range $\alpha$ becoming smaller while the camshaft is retarded. The engine start operating mode is provided for the controlled use of the intrinsic dynamics of the motor vehicle camshaft adjusting device. These intrinsic dynamics are in particular determined by the valve spring 39 and the rotation of the camshaft 12. When the inlet valve 13 opens, the camshaft 12 is retarded by the valve force of the valve spring 39. This retardation of the camshaft 12 decelerates the adjusting gear element 18 of the adjusting gear 16, retarding the adjusting gear 16. Depending on a speed and on the dynamics of the camshaft adjuster 14, the adjusting gear 16 is maximally retarded to a retard stop. The opening of the inlet valve 13 is retarded by intrinsic dynamics. The engine start operating mode uses the retardation determined by intrinsic dynamics in order to set the opening of the inlet valve 13 to as late a time as possible. This advantageously results in high rates of inflow in the cylinders.

When the inlet valve 13 closes, the intrinsic dynamics effect an acceleration of the camshaft 12. The camshaft 12 is once again accelerated by an energy introduced into the valve spring 39 by the opening of the inlet valve 13. By relaxing, the valve spring 39 transmits this energy to the camshaft 12, thereby supporting its advance rotation. The acceleration of the camshaft 12 in turn accelerates the adjusting element 18 of the adjusting gear 16, advancing the adjusting gear 16. Depending on a speed and the dynamics of the camshaft adjuster 14, the adjusting gear 16 is maximally advanced to an advance stop. The closing of the inlet valve 13 is advanced by the intrinsic dynamics. The engine start operating mode uses the advance determined by intrinsic dynamics in order to set the closing of the inlet valve 13 to as early a time as possible. This prevents the pushing-out of the filling or charge from the cylinder. The result is a maximum cylinder charge and a maximum engine starting torque.

The first actuation of the inlet valve 13 preferably occurs in only a relatively small crankshaft angle range. Because of the low engine starting speed, the cylinder however is filled completely. As the speed increases after the first power stroke, a base position of the adjusting gear 16 is approached; this occurs within the camshaft adjusting range 40 or at the advance stop. The cylinder charge or filling is heated by the late intake start before the first ignition and reaches a high turbulence, resulting in a good mixture formation in the cylinder. This means that the late intake start results in a pronounced charge movement and an increase in charge temperature. The early ending of the intake results in optimum cylinder charge for the first ignition.

By retarding the opening of the inlet, valve 13 and by advancing the closing of the inlet valve 13, the valve opening angle range α is reduced compared to the normal opening angle range. By means of a highly dynamic camshaft adjuster 14, the valve opening angle range is reduced to a value derived from the differential between the normal opening angle range β and nearly the camshaft adjusting range 40.

In the engine start mode, the open- and closed-loop control unit 11 actively supports the intrinsic dynamics of the camshaft adjuster 14. To support the intrinsic dynamics, the open- and closed-loop control unit 11 is provided for cyclically selecting the adjusting unit 26. The adjusting unit 26 sets the camshaft 12 to a defined phase position, retarding it at the opening of the inlet valve 13 and advancing it at the closing of the inlet valve 13. The adjusting unit 26 is provided for actively adjusting the valve opening angle range α. Before the inlet valve 13 opens, the adjusting unit 26 actively retards the phase position of the camshaft 12. By selecting the solenoid coil unit 34, the open- and closed-loop control unit 11 reduces the braking torque of the adjusting unit 26 compared to the braking torque for setting a constant phase position. The braking torque is reduced to a minimum. The retardation of the camshaft 12 caused by the intrinsic dynamics of the motor vehicle camshaft adjusting device is additionally reinforced by the reduction of the braking torque.

Immediately after an opening of the inlet valve 13, the adjusting unit 26 actively advances the phase position of the camshaft 12. By selecting the solenoid coil unit 34, the open- and closed-loop control unit 11 increases the braking torque of the adjusting unit 26 compared to the braking torque for setting a constant phase position. The braking torque is increased to a maximum. The advance of the camshaft 12 caused by the intrinsic dynamics of the motor vehicle camshaft adjusting device is additionally reinforced by the increase of the braking torque.

At the engine start time, the open- and closed-loop control unit 11 switches from the engine start operating mode to the normal operating mode. At the engine start time, all cylinders of the motor vehicle internal combustion engine have fired at least once. No later than on reaching idle speed, the open- and closed-loop control unit 11 switches to the normal operating mode and sets the phase position of the camshaft 12 to a constant phase position which corresponds to idling operation.

What is claimed is:

1. A motor vehicle camshaft adjusting device comprising an open- and a closed-loop control unit (11) provided for adjusting a phase position of a camshaft (12) and for adjusting the camshaft phase position in a normal operating mode with a predetermined valve opening angle range (β) corresponding to the geometry of the respective cam, the camshaft adjusting device including a frictional coupling element for controlling the camshaft advance or retardation by the control unit (11), the control unit (11) having an engine start operating mode which is provided for setting a valve opening angle range (α), which is smaller than the geometric normal valve opening angle range (β) as a result of a camshaft retarding and advancing movement during the valve opening period, by permitting in the engine start-up mode a retardation of the camshaft and the cam during a valve opening period by the force required for lifting the valve against the force of the valve spring of the cam and an advance of the camshaft during a valve closing period by the force of the valve spring on the cam.

2. The motor vehicle camshaft adjusting device according to claim 1, wherein the open- and/or closed-loop control unit (11) is provided for switching the valve opening angle range (α) provided for the engine start operating mode to the angle range (β) provided for the normal engine operating mode.

3. The motor vehicle camshaft adjusting device according to claim 2, wherein the open- and/or closed-loop control unit (11) is provided for switching from the engine start operating mode to the normal operating mode when the engine has reached an idling speed.

4. The motor vehicle camshaft adjusting device according to claim 1, wherein a highly dynamic camshaft adjuster (14) is provided for adjusting the phase position of the camshaft (12).

5. The motor vehicle camshaft adjusting device according to claim 4, wherein the camshaft adjuster (14) has a camshaft adjusting range (40) which covers a crankshaft angle range of at least 120 degrees.

6. The motor vehicle camshaft adjusting device according to claim 4, wherein the camshaft adjuster (14) is an electromagnetic camshaft adjuster.

7. The motor vehicle camshaft adjusting device according to claim 5, wherein the camshaft adjuster (14) is designed for adjusting the valve opening angle range (α) in the engine start operating mode to a value which corresponds to the normal opening angle range (β) minus half of the camshaft adjusting range (40).

8. The motor vehicle camshaft adjusting device according to claim 5, wherein the camshaft adjuster (14) comprises an adjusting unit (26) for actively adjusting the valve opening angle range (α) in the engine start operating mode.

9. The motor vehicle camshaft adjusting device according to claim 8, wherein the open- and/or closed-loop control unit (11) is provided for cyclically controlling the adjusting unit (26) in the engine start operating mode.

10. A method for operating a motor vehicle camshaft adjusting device according to claim 1, the method comprising the steps of: operating the open- and/or closed-loop control unit (11) so as to change the phase position of at least one camshaft (12) to an at least intermittently constant phase position, and operating the open- and/or closed-loop control unit (11) to advance the camshaft (12) in an engine start operating mode, during valve opening by permitting the camshaft to be retarded by the force required to open the valve against the force of the valve spring and to be advanced by the force generated by the valve spring upon closing of the valve thereby to provide for a valve opening angle range (α) which is smaller than a geometric normal opening angle range (β) provided by the cam design.

* * * * *